United States Patent [19]

Whited

[11] 4,032,228

[45] June 28, 1977

[54] FOREIGN OBJECT DETECTOR/BRUSH CLEANER

[75] Inventor: Charles A. Whited, Rochester, N.Y.

[73] Assignee: Xerox Corporation, Stamford, Conn.

[22] Filed: June 27, 1974

[21] Appl. No.: 483,868

[52] U.S. Cl. ..... 355/15; 271/258; 355/3 R; 355/14

[51] Int. Cl.² ..... G03G 21/00

[58] Field of Search ..... 271/DIG. 2, 258, 259; 355/3 R, 14, 15

[56] References Cited

UNITED STATES PATENTS

| | | | |
|---|---|---|---|
| 3,650,617 | 3/1972 | Baxter et al. | 355/3 R |
| 3,791,729 | 2/1974 | Steiner | 355/3 R |
| 3,831,933 | 8/1974 | Fantozzi | 271/258 |

*Primary Examiner*—Fred L. Braun
*Attorney, Agent, or Firm*—Earl T. Reichert

[57] ABSTRACT

A reproduction machine having a cleaning brush mechanism for cleaning the photoreceptor surface of the machine has a detector mounted within the mechanism for sensing the presence of any transfer sheet which might accidently enter the mechanism. The cleaning brush mechanism includes a brush rotatably mounted within a housing, the preferred embodiment of the invention having a crystal pickup with a probe mounted adjacent to the periphery of the brush and adjacent to the entrance to the housing in the direction of rotation of the brush. A transfer sheet entering the housing will "accordian" or crumple, thus contacting the probe to generate a signal.

1 Claim, 4 Drawing Figures

FOREIGN OBJECT DETECTOR/BRUSH CLEANER

BACKGROUND OF THE INVENTION

This invention relates to apparatus for monitoring the operation of a sheet transport mechanism, but more particularly to apparatus for detecting the presence of an image receiving medium or transfer member, e.g., paper, within the cleaner brush housing of an electrostatic reproduction machine.

In the practice of xerography as described in U.S. Pat. No. 2,297,691 to Chester F. Carlson, a xerographic surface comprising a layer of photoconductive insulating material affixed to a conductive backing is used to support electrostatic images. In the usual method of carrying out the process, the xerographic plate is electrostatically charged uniformly over its surface and then exposed to a light pattern of the image being reproduced to selectively dissipate a charge in the areas where light strikes the layer. The undischarged areas of the layer thus form an electrostatic charge pattern in conformity with a configuration of the original light pattern.

The electrostatic latent image may then be developed by contacting it with a finely divided electrostatically attractable material, such as a resinous powder. The powder is held in the image areas by the electrostatic field on the layer. Where the field is greatest, the greatest amount of material is deposited; and where the field is least, little or no material is deposited. Thus, a viewable powder image is produced in conformity with the light image of the copy being reproduced. The powder is subsequently transferred to a sheet of paper (the example used hereafter) or other image receiving medium and suitably fused to thereby form a permanent print.

It is contemplated that the developed viewable image which is supported on the support surface is to be dynamically transferred to the paper. Thus, the support surface is capable of being continuously transported in synchronism with the paper that is transported to a transfer station. At the transfer station, the paper contacts the support surface in a manner to facilitate the transfer of the developed image to the paper. Subsequent to the transfer of the developed image, the paper is removed from the support surface and transported to subsequent operating stations, such as a fusing station. Concurrently therewith, the support surface is transported to further operating stations where the support surface is cleaned and prepared for subsequent reuse thereof.

Although the foregoing is a general description of the normal operation of a portion of a typical electrostatic reproduction machine, it is not unreasonable to expect that, at times, the paper to which the developed image has been transferred might not be removed from the support surface subsequent to the transfer operation. In this instance, a final copy of the reproduced image will not be received and, moreover, the support surface cannot be properly reused for subsequent reproducing operations. Furthermore, the presence of the paper on the support surface at stations other than the transfer station disrupts the proper operation of the electrostatic reproduction machine resulting in the possibility of serious damage to the machine. Various prior art electrostatic reproduction machines have attempted to provide against these undesired occurrences by monitoring the progress of an image receiving medium as it is transported through the various operating stations of the machine. Accordingly, if a sheet of paper is detected at a location along the transport path prior to the transfer station, but not at a location along the transport path following the transfer station, it is presumed that the paper has not been removed from its contacting relationship with the support surface and further operation of the electrostatic reproduction machine is terminated.

One disadvantage of prior art reproduction machines is the failure of the jam detection mechanism to safeguard the operation of the machine if superposed or multiple sheets of paper are transported to the transfer station. More particularly, if superposed sheets are transported into a contacting relationship with the support surface, the developed image will be transferred to the lower sheet and the upper sheet will be successfully conveyed to the further operator stations, such as the fuser station, by the sheet transport mechanism. The lower sheet, however, will remain in contact with the support surface, and may enter the cleaner-brush housing, which may result in serious damage of the machine. Nevertheless, the presence of a sheet of paper will be detected at a location along the transport path following the transfer station. Consequently, the electrostatic reproduction machine will continue to operate notwithstanding the occurence of a condition that requires correction.

Also, some systems indicate that there is a paper jam, but these systems do not always indicate the location (s) of the jam. In such instances, the jam may be located in several areas including the cleaner-brush housing. If the operator is not aware that paper is in the cleaner-brush housing, he may clear the jam in the other location, and restart the machine. If the paper in the cleaner-brush housing remains undetected for a period of time, the cleaning mechanism will not function effectively, thus eventually resulting in large accumulations of toner dust within the machine, poor quality, and possible breakdown of the machine.

SUMMARY OF THE INVENTION

Accordingly, it has been found necessary to provide means for detecting when an image receiving medium has actually entered the cleaner-brush housing so that the proper warning or corrective action can be effected. The preferred embodiment utilizes a crystal pickup and wire probe located adjacent to the outer periphery of the brush, and adjacent to the entrance to the housing to detect the presence of any paper which has entered the housing. If paper has entered the housing a higher than normal noise level is created, and thus a signal is generated, amplified, and utilized to effect the desired warning or corrective action.

DETAILED DESCRIPTION OF THE INVENTION

Figure 1:
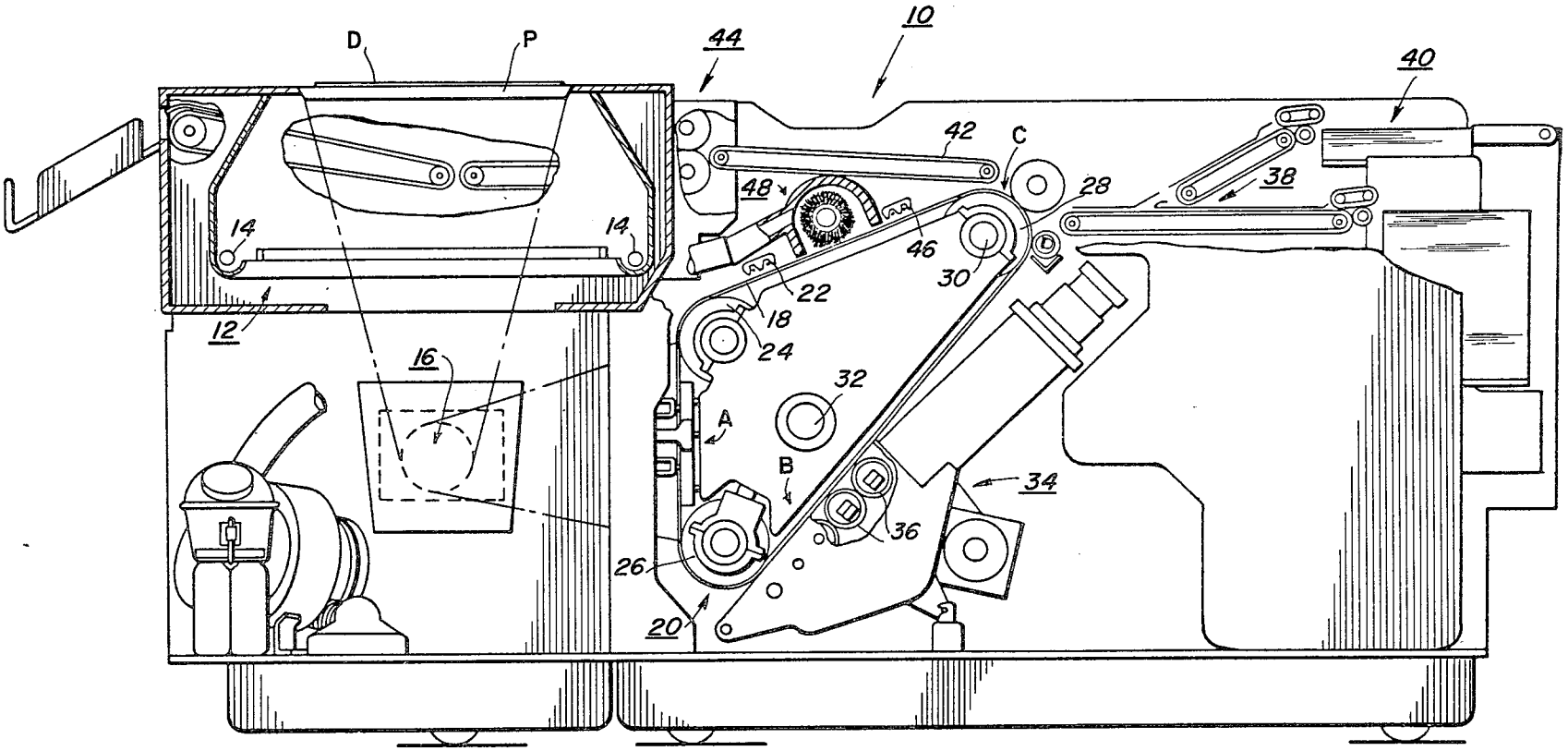
FIG. 1 is a schematic sectional view of an electrostatic reproduction machine embodying the principles of the instant invention.

For a general understanding of a reproduction machine in which the invention may be incorporated, reference is had to FIG. 1 in which the various system components for the machine are schematically illustrated.

In the illustrated machine 10, a document D to be copied is placed upon a transparent support platen P fixedly arranged in an illumination assembly, generally indicated by the reference numeral 12, positioned at the left end of the machine. In the embodiment illustrated, the illumination assembly includes suitable lamps 14 capable of being rapidly discharged to create a bright flash of light. Light rays from the lamps are flashed upon the document to produce image rays corresponding to the information areas thereon. The image rays are projected by means of an optical system 16 onto the photosensitive surface of a photoreceptor which is in the form of flexible photoconductive belt 18 arranged on a belt assembly, generally indicated by the reference numberal 20.

The belt 18 comprises a photoconductive layer of selenium, which is the light receiving surface and imaging medium for the apparatus, on a conductive backing. The surface of the photoconductive belt is made photosensitive by a previous step of uniformly charging the same by means of a corona generating device 22.

The belt is journaled for continuous movement upon three rollers 24, 26, and 28 positioned with their axes in parallel. The photoconductive belt assembly 20 is slidably mounted upon two support shafts 30 and 32 with the roller 28 rotatably supported on shaft 30, the latter being secured to the frame of the apparatus and rotatably driven by a suitable motor and drive assembly (not shown) in the direction of the arrow at a constant rate. During exposure of the belt 18, the portion exposed is that portion of the belt running between rollers 24 and 26. As the belt is transported in the indicated direction, the projected light image of the original document positioned on the platen is flashed on the surface of the belt to produce an electrostatic latent image thereon at exposure station A.

The belt surface continues its movement whereby the electrostatic latent image passes through a developing station B in which there is positioned a developer assembly generally indicated by the reference numeral 34 which provides development of the electrostatic latent image by means of magnetic brushes 36 as the image moves through the development zone. In the illustrated embodiment, it may be appreciated that belt 18 now serves as a suitable support surface to support the developed image of the character pattern presented by the original document.

The developed image carried by the support surface is transported to a transfer station C where a transfer member is moved between a transfer roller and the support surface at a speed in synchronism with the moving support surface in order to accomplish a final transfer of the developed image by an electrical bias on the transfer roller. As illustrated in FIG. 1, the support surface here comprises belt 18, and the transfer member is transported between a transfer roller and the belt in a contacting relationship with the support surface. A sheet transport mechanism, generally indicated at 38, is adapted to transport the transfer members (e.g., sheets of paper) from a movable platform, indicated generally by the reference numeral 40, to the developed image on the support surface at the station C.

After the developed image is transferred from the support surface to the transfer member, the latter is removed from its contacting relationship and directed onto a further sheet transport mechanism, the further sheet transport mechanism including endless belt 42. The removed transfer member is transported by the sheet transport mechanism into a fuser assembly, indicated generally by the reference numeral 44, wherein the developed and transferred powder image is permanently affixed to the transfer member. The further sheet transport mechanism may include suitable vacuum means, such as a conventional vacuum shoe, capable of reducing the air pressure above endless belt 42, resulting in a force which urges the transfer member against the belt. After fusing, the finished transfer member is discharged from the apparatus at a suitable point for collection therefrom.

The support surface, after passing the transfer station C is conveyed to a cleaning station comprised of precleaning corotron 46 and cleaner-brush mechanism 48. The precleaning corotron serves to discharge the remaining charged areas present on the support surface. The cleaner-brush mechanism 48 is capable of removing the residual electroscopic particles that have not been transferred from the support surface to the transfer member. Accordingly, the mechanism 48 includes a suitable brush housing in which is disposed a rotatable brush such as a fur brush. Electroscopic particles thus removed from the support surface are conveyed to a reclaiming system by air circulating through an air duct that extends from the brush housing to the reclaiming system. The support surface is now adapted to be reused for a subsequent reproduction operation.

Figure 2:
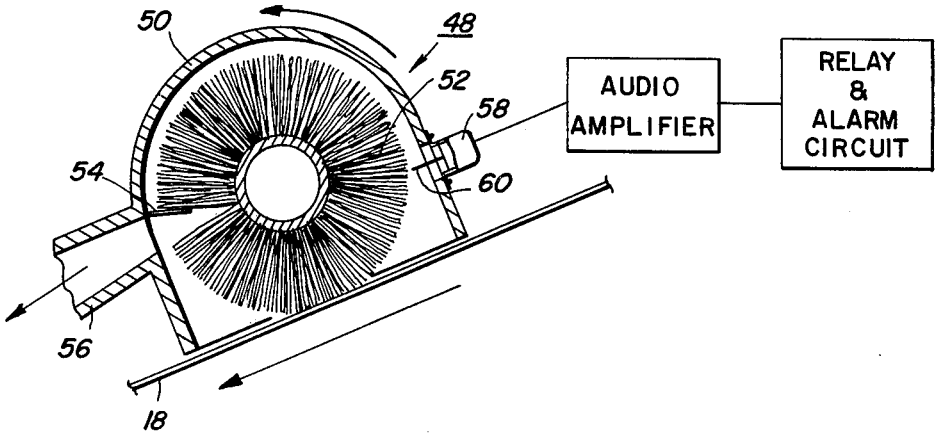
FIGS. 2 and 3 are schematic illustrations of the preferred embodiment of the invention, i.e., the crystal pickup embodiment.

Referring to FIG. 2, the preferred embodiment of the invention is shown. As stated above, the mechanism 48 includes a housing 50 in which a brush 52 is rotatably mounted. As the brush 52 rotates, it removes the toner from the belt 18. Any toner on the brush is subsequently removed as the brush contacts a flicker bar 54, the removed toner then being conveyed by a vacuum dust 56 to a toner reclaiming system.

As previously stated, anything interferring with the efficient operation of the cleaner-brush mechanism 48 (e.g., paper entering the housing 50) will ultimately result in large accumulations of toner dust with the reproduction machine 10, thus resulting in poor copy quality and possible machine breakdown. To detect the presence of any paper which has actually entered the housing 50, a crystal pickup 58 is mounted to the housing so that its probe 60 is located immediately adjacent to the periphery of the brush. It is noted that the probe 60 is located adjacent to the entrance to the housing in the direction of rotation of the brush 52. Any paper entering the housing will tend to accordian or crumple and will be conveyed toward the probe 60, thus causing the paper to contact the probe 60 to cause an electrical output signal. In any event, the probe 60 is located sufficiently close to the brush so that a transfer member conveyed in that direction will contact the probe. This output signal is then amplified by a conventional amplifier to drive any other circuit required for corrective action. For example, the amplified signal may be used as shown to sound an audible alarm, or to illuminate a warning light, or to disrupt the operation of the main drive motor for the machine 10.

Figure 3:
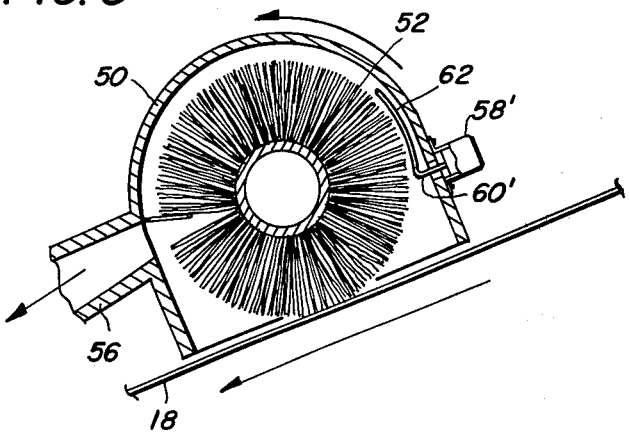

FIG. 3 again shows a crystal pickup 58' mounted to the housing 50, but the probe 60' includes an arcuate portion 62 which is located immediately adjacent to the periphery of the brush. This embodiment functions in the same manner as that shown in FIG. 2. The crystal pickup embodiment of FIGS. 2 and 3 are preferred in that they are not only effective, but also relatively economical and simple as compared with other possible arrangements.

Figure 4:
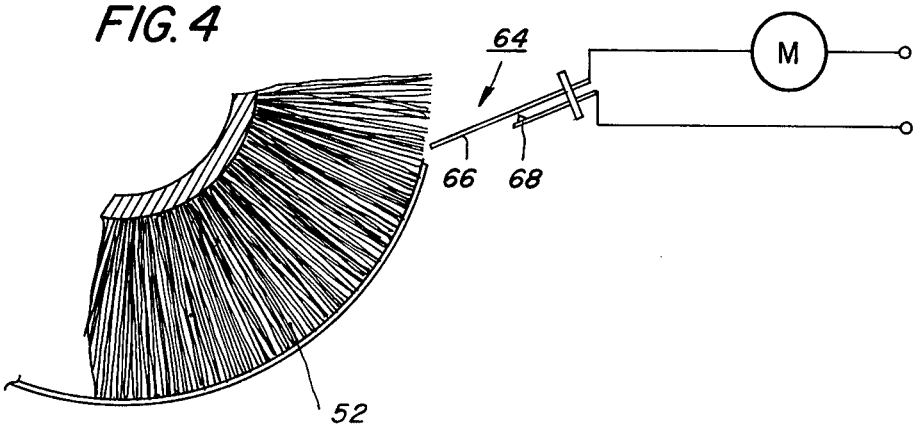
FIG. 4 is a schematic view of an alternate embodiment of the invention.

FIG. 4 shows a third embodiment of the invention wherein a switch 64 having an element 66 which normally contacts the contact 68 to close the circuit for the main drive motor of the machine 10. Element 66 is mounted so that its tip is located immediately adjacent to the periphery of the brush. Any paper entering the housing and contacting the element 66 is sufficient to move the element out of contact with contact 68, thus opening the circuit to the main drive motor. This embodiment can also be used to sound an alarm, illuminate a warning light, or drive any other circuitry required for corrective action similr to the embodiment shown in FIGS. 1 and 2.

In addition to the embodiments described, other arrangements may be used for detecting the presence of a transfer member within the housing 50. For example, a differential pressure switch might be used to detect changes in the vacuum within the housing resulting from paper entering the housing. Depending upon the location of the paper, etc., however this arrangement might not respond as quickly to the presence of paper as the described embodiments, because there may not be a sufficient reduction in pressure to actuate the switch until several transfer members become entrapped in the housing. In contrast to this, the crystal pickup embodiment of FIGS. 2 and 3 will respond almost immediately to the presence of a transfer member within the housing because the probe is located immediately adjacent to the opening of the housing in the direction of the rotation of the brush. Also, a piezoelectric transistor or impact switch could be used.

While the invention has been described with reference to the structure disclosed, it is not confined to the details set forth, but is intended to cover such modifications or changes as may come within the scope of the following claims.

What is claimed is:

1. An improved reproduction machine having means defining a support surface on which an image may be formed, means for moving the support surface around a closed path, means for forming a developed image on the support surface, means for transfering the developed image to a transfer member, and means including a housing having an opening and a brush mounted for rotation within the housing and extending through the opening for cleaning the support surface after the developed image has been transferred and before another image has been formed on the same portion of the support surface, the improvement comprising:

means including a crystal pickup and a probe disposed immediately adjacent to the periphery of the brush for detecting the presence of a transfer member within the housing.

* * * * *